US006989722B2

(12) United States Patent
Okada et al.

(10) Patent No.: US 6,989,722 B2
(45) Date of Patent: Jan. 24, 2006

(54) DIELECTRIC FILTER, DIELECTRIC DUPLEXER, AND COMMUNICATION APPARATUS

(75) Inventors: Takahiro Okada, Kanazawa (JP); Jinsei Ishihara, Kanazawa (JP); Hideyuki Kato, Ishikawa-ken (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 45 days.

(21) Appl. No.: 10/400,621

(22) Filed: Mar. 28, 2003

(65) Prior Publication Data

US 2003/0189470 A1 Oct. 9, 2003

Related U.S. Application Data

(62) Division of application No. 10/076,705, filed on Feb. 13, 2002, now Pat. No. 6,566,987.

(30) Foreign Application Priority Data

Feb. 19, 2001 (JP) ..... 2001-041847

(51) Int. Cl.
*H01P 1/205* (2006.01)
*H01P 1/203* (2006.01)

(52) U.S. Cl. ..... 333/26; 333/134; 333/204

(58) Field of Classification Search ..... 333/134, 333/202–207, 26
See application file for complete search history.

(56) References Cited

U.S. PATENT DOCUMENTS 5,422,610 A 6/1995 Heine et al.
5,537,082 A * 7/1996 Tada et al. ..... 333/202
5,929,725 A 7/1999 Toda et al.

(Continued)

FOREIGN PATENT DOCUMENTS

JP 2-100304 8/1990

(Continued)

OTHER PUBLICATIONS

Copy of Japanese Examination Report dated Jun. 22, 2004 (and English translation of same).

(Continued)

*Primary Examiner*—Dinh T. Le
(74) *Attorney, Agent, or Firm*—Dickstein, Shapiro, Morin & Oshinsky, LLP.

(57) ABSTRACT

In a dielectric filter, from the top surface to the bottom surface of a substantially rectangular dielectric block, inner-conductor holes are formed. On the inner surfaces of the inner-conductor holes, inner conductors are formed except where non-conductor portions are formed in proximity to one of the top and bottom surfaces, in which the apertures of the inner-conductor holes are formed. On the outer surface of the dielectric block, an outer conductor is formed substantially over the entire outer surface, and input and output electrodes isolated from the outer conductor are coupled with the non-conductor portions in the respective inner-conductor holes at the ends of the dielectric block in the direction of array of the inner-conductor holes. In one of the surfaces in which the apertures of the inner-conductor holes are formed, or in one of the surfaces at the ends of the dielectric block in the direction of array of the inner-conductor holes, a concavity is formed, the inner surface thereof being covered with the outer conductor.

5 Claims, 18 Drawing Sheets

U.S. PATENT DOCUMENTS

| | | | | |
|---|---|---|---|---|
| 5,949,308 | A | 9/1999 | Hino | |
| 6,236,288 | B1 * | 5/2001 | Tsujiguchi | 333/134 |
| 6,304,158 | B1 * | 10/2001 | Nishijima et al. | 333/206 |
| 6,476,687 | B1 | 11/2002 | Miyamoto et al. | |
| 6,535,077 | B1 * | 3/2003 | Hiroshima et al. | 333/26 |
| 6,686,813 | B2 * | 2/2004 | Hiroshima et al. | 333/134 |

FOREIGN PATENT DOCUMENTS

| | | |
|---|---|---|
| KR | 2002-0056754 | 7/2002 |

OTHER PUBLICATIONS

Copy of Korean Office Action dated Feb. 25, 2004 (and English translation of relevant portion).

* cited by examiner

DIELECTRIC FILTER, DIELECTRIC DUPLEXER, AND COMMUNICATION APPARATUS

CROSS REFERENCE TO RELATED APPLICATION

This application is a divisional of application Ser. No. 10/076,705, entitled DIELECTRIC FILTER, DIELECTRIC DUPLEXER, AND COMMUNICATION APPARATUS, filed Feb. 13, 2002, now U.S. Pat. No. 6,566,987.

BACKGROUND OF THE INVENTION

1. Field of the Invention

The present invention relates to dielectric filters, dielectric duplexers, and communications apparatuses used mainly in the microwave band.

2. Description of the Related Art

In a known type of dielectric filter including a substantially rectangular dielectric block, the dielectric block, inner conductors, and an outer conductor constitute resonators in TEM modes, and the resonators are comb-line coupled with each other via stray capacitance generated at portions of the resonators where no conductors are formed, whereby the dielectric filter is formed.

However, in a dielectric duplexer in which an outer conductor is formed on the outer surface of such a substantially rectangular dielectric block, the dielectric block and the outer conductor cause a resonance in a mode, for example, the $TE_{101}$ mode, other than the TEM mode which is the fundamental resonance mode.

FIG. 22A is a diagram showing the distribution of a magnetic field in the $TE_{101}$ mode generated in the dielectric filter according to the related art, and FIG. 22B is a graph showing the attenuation characteristics of the dielectric filter.

As shown in FIG. 22B, when resonance occurs in a mode other than the fundamental mode, for example, in the TE mode, a plurality of resonance frequencies in the TE mode, in addition to the resonance frequency in the desired TEM mode, appear outside the band necessary for obtaining the desired characteristics of the filter, whereby the spurious-response characteristics of the dielectric filter are degraded.

Proposals have been made in order to avoid the effects of the TE mode. In a first proposed dielectric filter, because the frequency in the TE mode is affected by the outer dimensions of the dielectric filter, the outer dimensions are altered so as to shift the resonance frequency in the TE mode, whereby degradation of the spurious-response characteristics is avoided. In a second proposed dielectric filter, a portion of an outer conductor is cut, so that a perturbation is caused in the TE-mode resonance of the dielectric block and the outer conductor, shifting the frequency in the TE mode, whereby degradation of the spurious-response characteristics is avoided.

However, the dielectric filters according to the related art have suffered the following problems to be solved.

According to the first proposed dielectric filter, the filter must be designed for the TEM mode while also taking the effects of TE mode into consideration. In addition, because size reduction of dielectric filters is constantly desired, larger outer dimensions are inhibited. Thus, flexibility in designing filters is diminished.

In the second proposed dielectric filter, because a separate process of cutting the outer conductor is required, lead time and workload are increased, incurring additional manufacturing cost.

SUMMARY OF THE INVENTION

To address these problems, the present invention provides a dielectric filter, a dielectric duplexer, and a communications apparatus in which the resonance frequency in the TE mode is shifted so as to improve the spurious-response characteristics without incurring additional manufacturing cost or altering the overall outer dimensions.

To this end, the present invention, in one aspect thereof, provides a dielectric filter including a substantially rectangular dielectric block; a plurality of inner-conductor holes having respective apertures in a first end surface of the dielectric block and in a second end surface which is opposite to said first end surface of the dielectric block; a plurality of inner conductors formed respectively on the inner surfaces of the plurality of inner-conductor holes; at least one concavity formed either in one of the end surfaces in which the apertures of the plurality of inner-conductor holes are formed, or in one of the third and fourth end surfaces of the dielectric block which are arranged with the inner-conductor holes therebetween in the direction of array of the plurality of inner-conductor holes; and an outer conductor formed on the outer surface of the dielectric block including the inner surface of the at least one concavity; wherein the resonance frequency in a TE mode in which the electric field is aligned in the direction perpendicular to both the axial direction and the direction of array of the plurality of inner-conductor holes is shifted towards higher frequencies. Thus, the effects of TE modes can be readily diminished without altering the outer dimensions, so that the spurious-response characteristics are improved.

The at least one concavity may be formed substantially in the central portion of at least one of the first and second end surfaces in which the apertures of the plurality of inner-conductor holes are formed. Thus, mainly the effects of the $TE_{101}$ mode can be readily reduced without altering the outer dimensions, so that the spurious-response characteristics are improved.

The at least one concavity may be formed in at least one of the first and second end surfaces in which the apertures of the plurality of inner-conductor holes are formed, at a position spaced away from a corresponding nearest end surface in the direction of array of the plurality of inner-conductor holes, by a distance of approximately a quarter of the dimension of the dielectric block in said direction of array of the inner-conductor holes. Thus, mainly the effects of the $TE_{201}$ mode can be readily reduced without altering the outer dimensions, so that the spurious-response characteristics are improved.

The at least one concavity may be formed in a localized region not including spaces between the plurality of inner-conductor holes. Thus, the at least one concavity can be readily formed without altering the coupling capacitance between the inner-conductor holes. In addition, the effects of TE modes can be readily diminished without altering the outer dimensions, so that the spurious-response characteristics are improved.

The at least one concavity may be formed substantially in the central portion of at least one of the third and fourth end surfaces which are arranged at the ends in the direction of array of the plurality of inner-conductor holes. Thus, the effects of TE modes in general can be readily diminished without altering the outer dimensions, so that the spurious-response characteristics are improved.

The present invention, in another aspect thereof, provides a dielectric duplexer including a dielectric filter described above, so that the spurious-response characteristics can be readily improved to achieve good attenuation characteristics.

The present invention, in still another aspect thereof, provides a communications apparatus including the dielectric filter or the dielectric duplexer described above, so that the communications characteristics are improved.

Other features and advantages of the present invention will become apparent from the following description of embodiments of the invention which refers to the accompanying drawings.

DESCRIPTION OF EMBODIMENTS OF THE INVENTION

The construction of a dielectric filter according to a first embodiment will be described with reference to FIGS. 1A to 1C, FIGS. 2A and 2B, FIG. 3, FIG. 4, and FIGS. 5A to 5C.

Figure 1A:
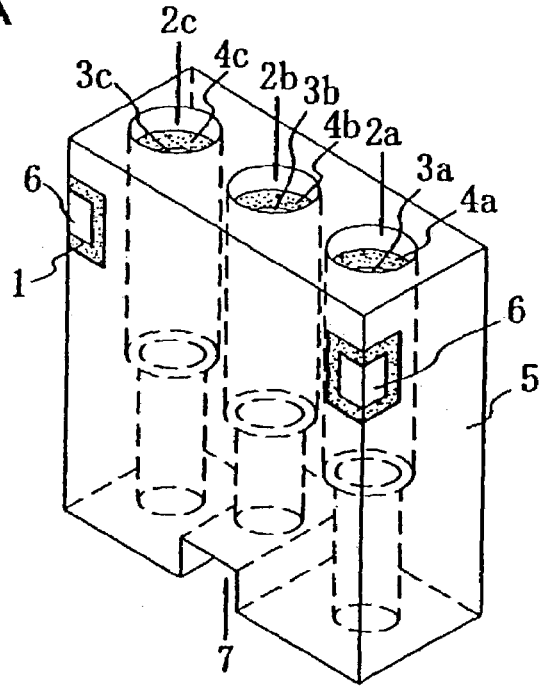
FIGS. 1A, 1B, and 1C are, respectively, an external perspective view, a side view, and a bottom view of a dielectric filter according to a first embodiment.
Figure 1B:
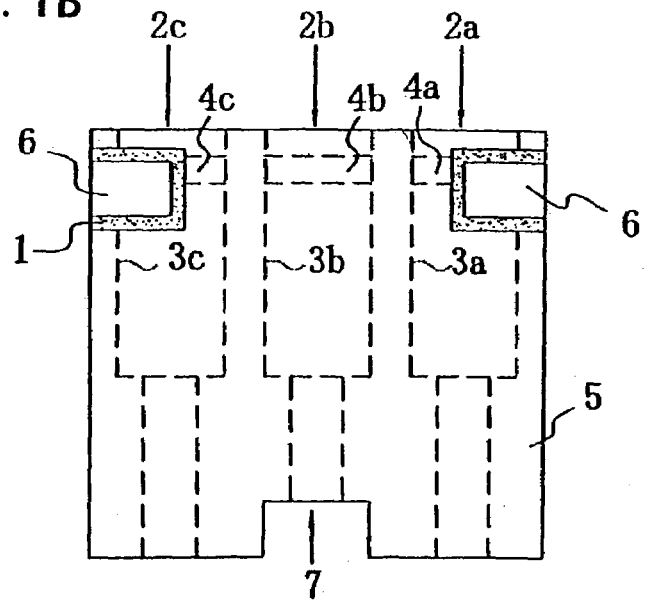
Figure 1C:
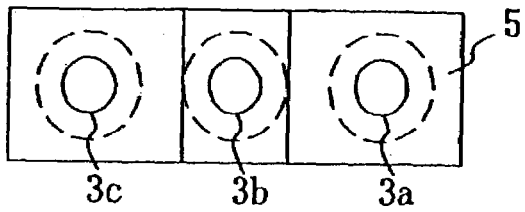

FIGS. 1A, 1B, and 1C are, respectively, an external perspective view, a side view, and a bottom view of the dielectric filter.

Figure 2A:
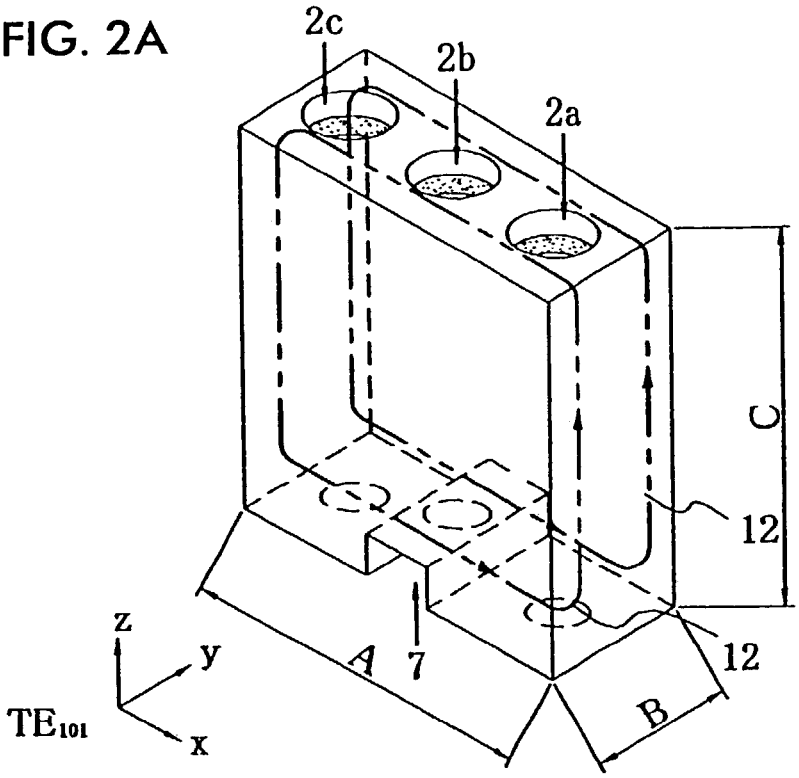
FIGS. 2A and 2B are diagrams showing the distributions of magnetic fields in the $TE_{101}$ mode generated in the dielectric filter according to the first embodiment.
Figure 2B:
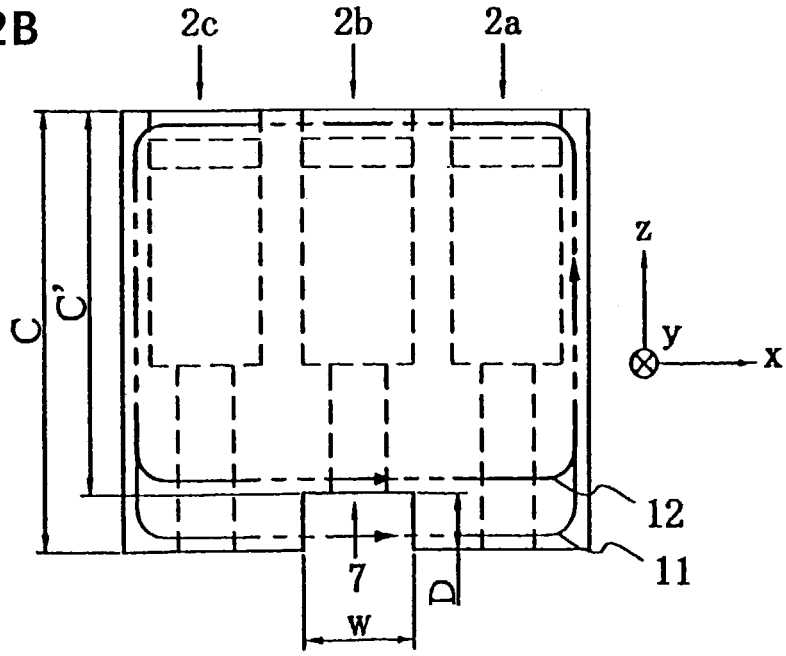

FIGS. 2A and 2B are, respectively, a perspective view and a side view showing the distribution of a magnetic field in the $TE_{101}$ mode generated in the dielectric filter.

Figure 3:
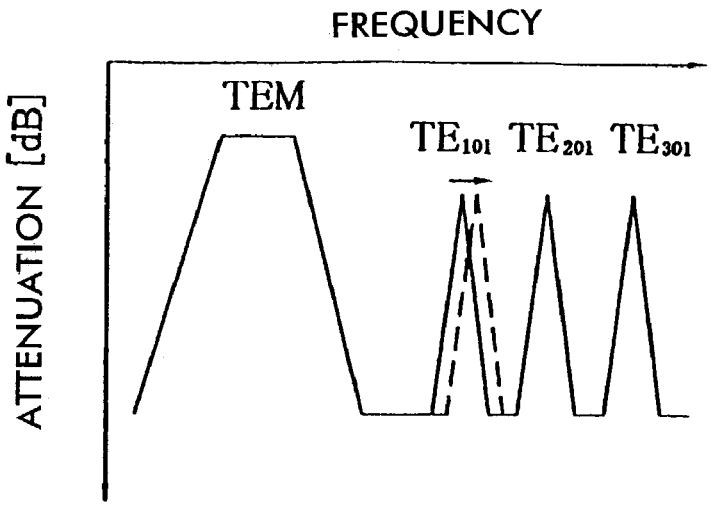
FIG. 3 is a graph showing the attenuation characteristics of the dielectric filter according to the first embodiment.

FIG. 3 is a graph showing the attenuation characteristics of the dielectric filter.

Figure 4:
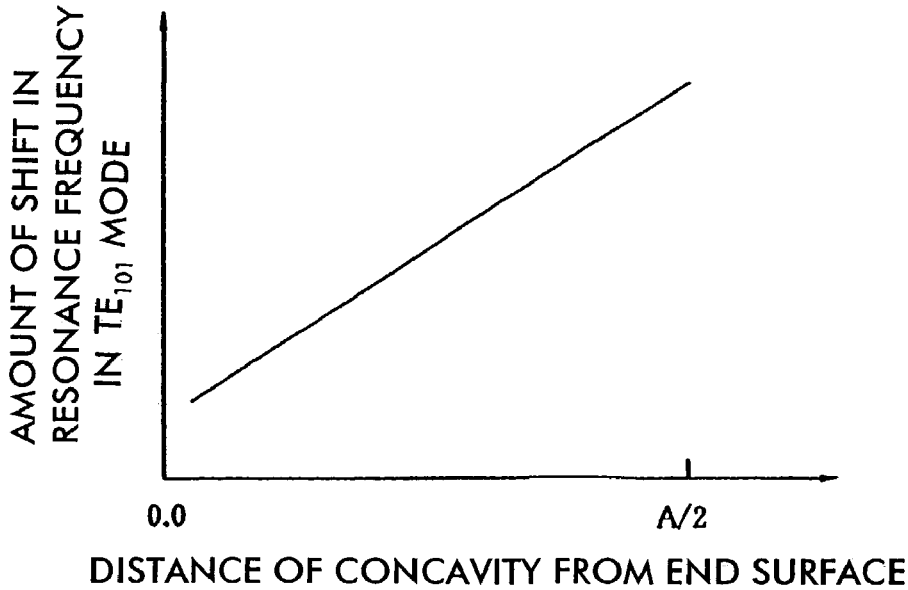
FIG. 4 is a graph showing the relationship between the position of a concavity and the amount of shift in the resonance frequency in the $TE_{101}$ mode.

FIG. 4 is a graph showing the relationship between the position of a concavity and the amount of shift in the resonance frequency in the $TE_{101}$ mode.

Figure 5A:
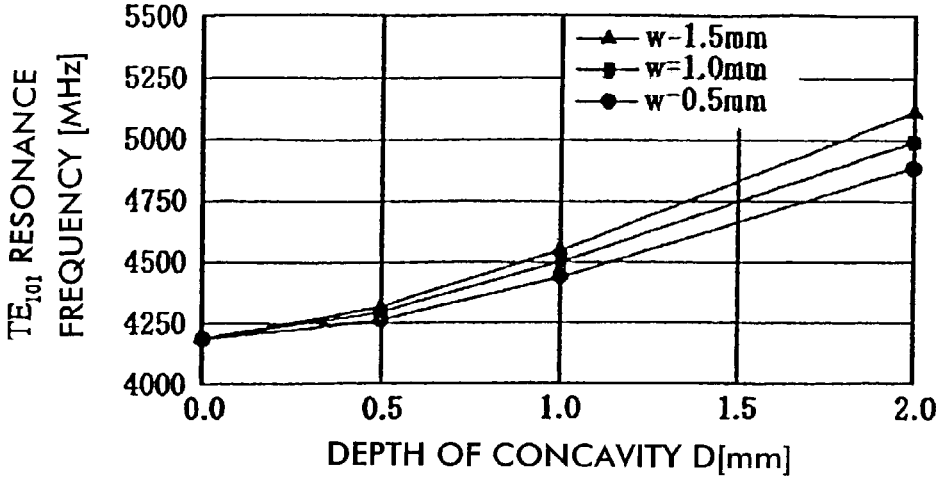
FIGS. 5A, 5B, and 5C are graphs showing variations in the resonance frequency in each TE mode in relation to the depth and width of a concavity.
Figure 5B:
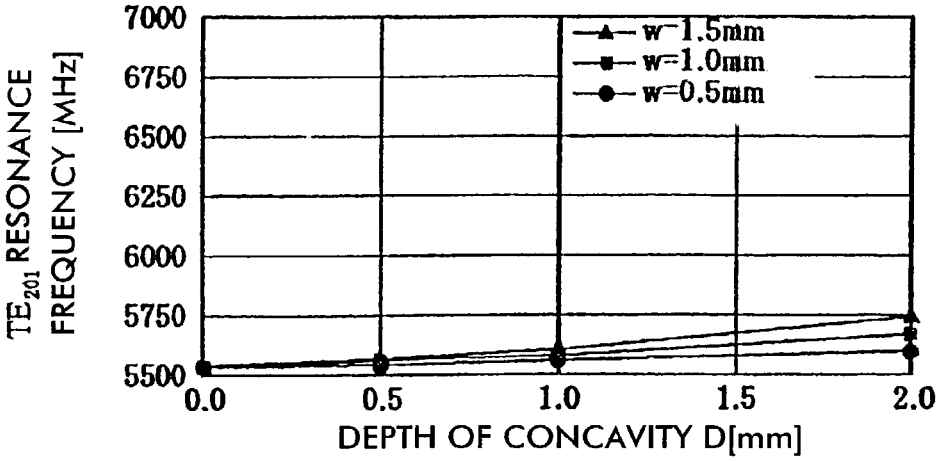
Figure 5C:
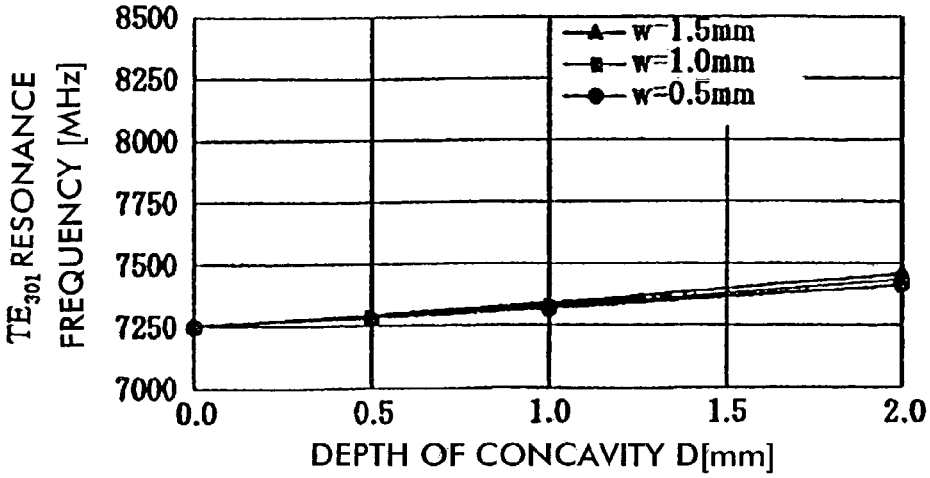

FIGS. 5A, 5B, and 5C are graphs showing variations in the resonance frequency in relation to the depth and width of the concavity, respectively in the $TE_{101}$ mode, the $TE_{201}$ mode, and the $TE_{301}$ mode.

In FIGS. 1A to 1C, 1 indicates a dielectric block, 2*a* to 2*c* indicate inner-conductor holes, 3*a* to 3*c* indicate inner conductors, 4*a* to 4*c* indicate non-conductor portions, 5 indicates an outer conductor, 6 indicate input and output electrodes, and 7 indicates a concavity.

Referring to FIGS. 1A to 1C, from the top surface to the bottom surface of the substantially rectangular dielectric block 1, the inner-conductor holes 2*a* to 2*c* are formed, and the inner conductors 3*a* to 3*c* are formed respectively on the inner surfaces of the inner-conductor holes 2*a* to 2*c*. The outer conductor 5 is formed substantially over the entire outer surface of the dielectric block 1.

In the inner-conductor holes 2*a* to 2*c*, the non-conductor portions 4 are formed respectively in the proximity of one of the first and second end surfaces in which the apertures of the inner-conductor holes 2*a* to 2*c* are formed. These portions define the open ends of the inner conductors 3*a* to 3*c*, and the other surface defines the shorted ends. On the outer surface of the dielectric block 1, the input and the output electrodes 6, isolated from the outer conductor 5, are formed so as to be capacitively coupled with the open ends.

Furthermore, in the proximity of the central portion of the shorted-end surface, the convexity 7 is cut into the dielectric block 1 in the axial direction of the inner-conductor holes 2*a* to 2*c*, the inner surface thereof being covered with the outer conductor 5, whereby the entire dielectric filter is formed.

In the dielectric filter of the above construction, a magnetic field in the $TE_{101}$ mode is distributed as shown in FIGS. 2A and 2B.

Referring to FIGS. 2A and 2B, 2*a* to 2*c* are the inner-conductor holes, and 7 is the concavity. 11 and 12 each show the distribution of a magnetic field in the $TE_{101}$ mode, respectively in a case where the concavity 7 is not provided and in a case where the concavity 7 is provided.

A indicates the length of the longer sides of the surfaces in which the apertures of the inner-conductor holes 2*a* to 2*c* are formed, B indicates the length of the shorter sides thereof, C indicates the length of the dielectric block in the axial direction of the inner-conductor holes 2*a* to 2*c*, C' is the distance from the inner surface of the concavity to the open-end surface, D is the depth of the concavity (length in the direction parallel to the axial direction of the inner-conductor holes 2*a* to 2*c*), and w is the width of the concavity (length in the direction parallel to the direction of array of the inner-conductor holes 2*a* to 2*c*).

The resonance frequency f in $TE_{mns}$ mode generated in the dielectric filter including the dielectric block can be expressed as:

$$f = \frac{v_c}{\sqrt{\varepsilon_r}} \frac{\sqrt{\left(\frac{m}{A}\right)^2 + \left(\frac{n}{B}\right)^2 + \left(\frac{s}{C}\right)^2}}{2} \tag{1}$$

where vc is the speed of light, ∈r is the relative dielectric constant of the dielectric material, and A, B, and C are the dimensions shown in FIG. 2A.

As shown in FIGS. 2A and 2B, due to the concavity 7 provided at the central portion of the shorted-end surface, a magnetic field in the $TE_{101}$ mode is distributed as indicated by 12, not as indicated by 11, so that the wavelength of the magnetic field component is equivalently shortened. That is, the length of the dielectric block 1 in the axial direction of the inner-conductor holes 2*a* to 2*c* is equivalently shortened from the length C to the length C', so that the resonance frequency becomes higher according to Eq. 1.

In terms of attenuation characteristics, as shown in FIG. 3, because the resonance frequency in the $TE_{101}$ mode is shifted, unwanted signals in the proximity of the resonance frequency in the $TE_{101}$ mode are suppressed, so that spurious-response characteristics in the proximity of the resonance frequency in the $TE_{101}$ mode are improved.

The concavity 7 may be provided at positions other than the central portion of the shorted-end surface. However, as shown in FIG. 4, the amount of shift in the resonance frequency in the $TE_{101}$ mode increases in accordance with the distance of the position of the concavity 7 from the nearer end surface of the dielectric block 1 in the direction of array of the inner conductor holes 2*a* to 2*c*, reaching the maximum at the central portion (A/2 distant from the end surface), when maximal improvement in spurious-response characteristics is obtained.

FIGS. 5A to 5C are graphs showing variations in the resonance frequency in TE modes when the depth D and the width w of the concavity are changed, when the dimensions in FIG. 2A are such that A is 10.4 mm, B is 2.0 mm, and C is 6.0 mm, and when the relative dielectric constant of the dielectric block 1 is 47.

As shown in FIGS. 5A to 5C, in each of the $TE_{101}$ mode, the $TE_{201}$ mode, and the $TE_{301}$ mode, the amount of shift in the resonance frequency can be increased by increasing the depth and the width of the concavity.

Next, the construction of a dielectric filter according to a second embodiment will be described with reference to FIGS. 6A and 6B, FIGS. 7A to 7C, and FIG. 8.

Figure 6A:
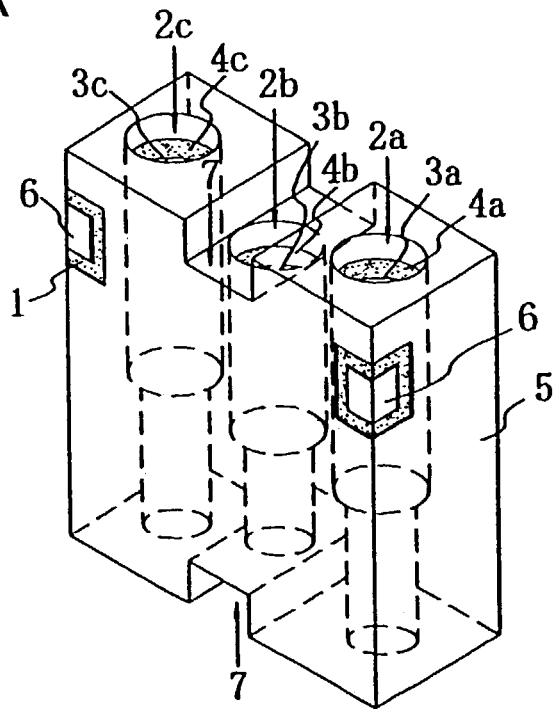
FIGS. 6A and 6B are, respectively, an external perspective view and a side view of a dielectric filter according to a second embodiment.
Figure 6B:
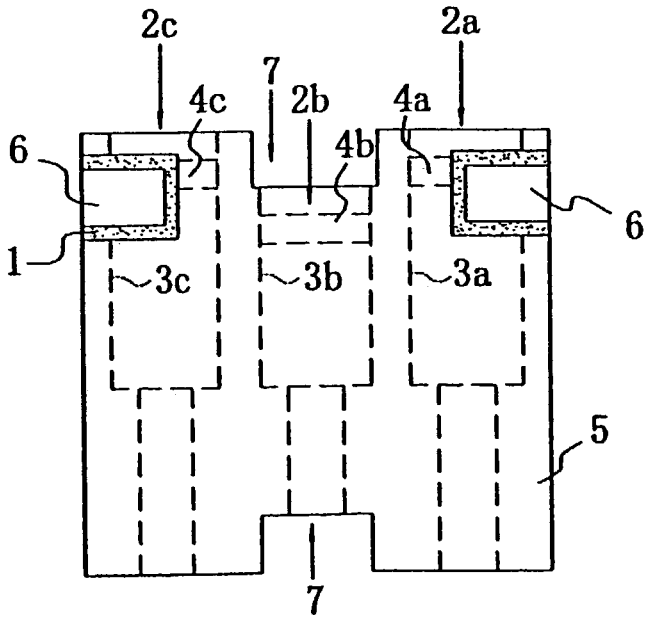

FIGS. 6A and 6B are, respectively, an external perspective view and a side view of the dielectric filter.

Figure 7A:
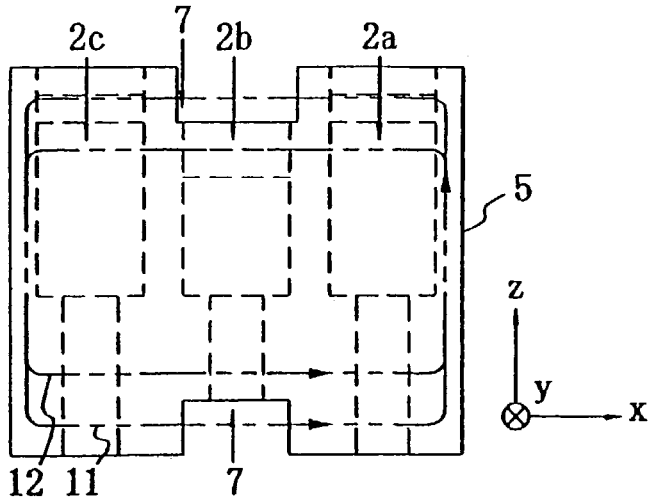
FIGS. 7A, 7B, and 7C are diagrams showing the distributions of magnetic fields in each TE mode generated in the dielectric filter according to the second embodiment.
Figure 7B:
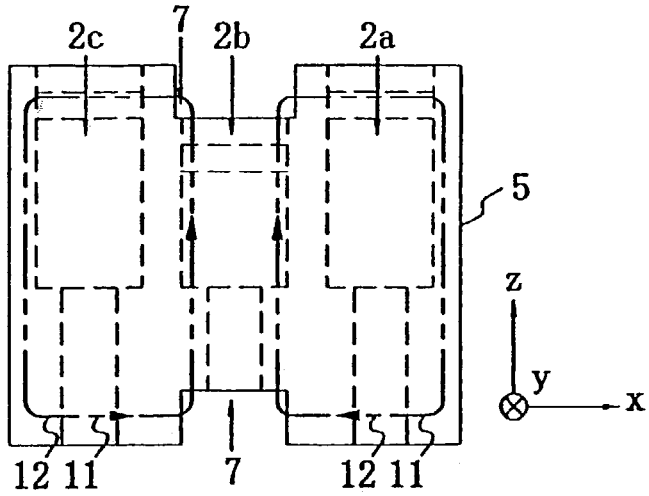
Figure 7C:
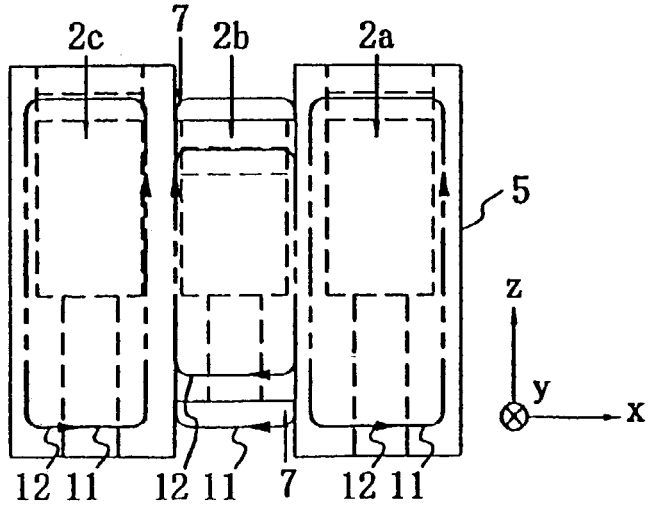

FIGS. 7A to 7C show the distributions of magnetic fields generated in the dielectric filter, respectively in the $TE_{101}$ mode, the $TE_{201}$ mode, and the $TE_{301}$ mode.

Figure 8:
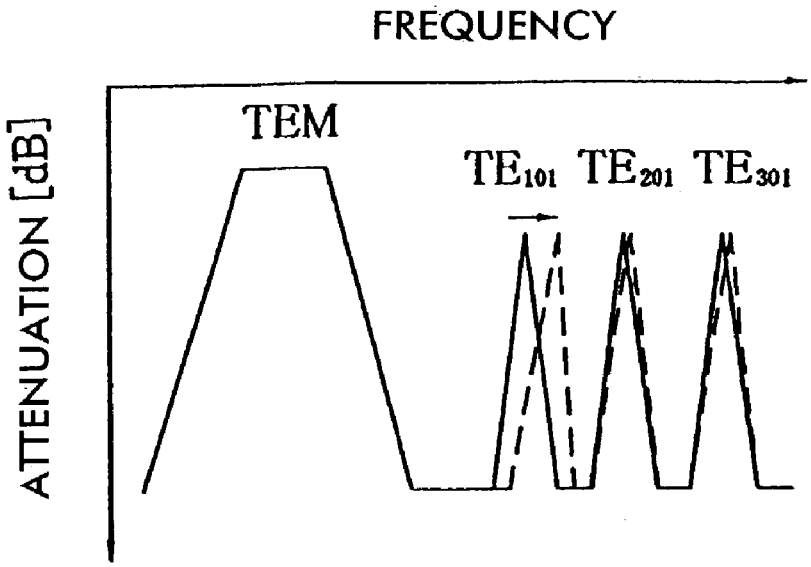
FIG. 8 is a graph showing the attenuation characteristics of the dielectric filter according to the second embodiment.

FIG. 8 is a graph showing the attenuation characteristics of the dielectric filter.

In FIGS. 6A and 6B and FIGS. 7A to 7C, 1 indicates a dielectric block, 2*a* to 2*c* indicate inner-conductor holes, 3*a* to 3*c* indicate inner conductors, 4*a* to 4*c* indicate non-conductor portions, 5 indicates an outer conductor, 6 indicate input and output electrodes, and 7 indicate concavities. 11 and 12 show the distributions of magnetic fields in each of the TE modes, respectively for a case where the concavities 7 are not provided and for a case where the concavities 7 are provided.

In the dielectric filter shown in FIGS. 6A and 6B, the concavities 7 are formed respectively in the central portions of both of the surfaces on which the apertures of the inner-conductor holes 2*a* to 2*c* are formed. The construction of the dielectric filter is otherwise the same as that of the dielectric filter according to the first embodiment.

According to the above construction, the concavities 7 are formed in the regions where the magnetic field in the $TE_{101}$ mode is most intense, as shown in FIG. 7A. Thus, the distribution of magnetic field is significantly altered, so that the wavelength of the magnetic field component in the $TE_{101}$ mode is equivalently shortened, whereby the resonance frequency is shifted towards higher frequencies.

Furthermore, with respect to the $TE_{201}$ mode, the concavities 7 are formed in the regions where the magnetic field is weak, as shown in FIG. 7B, exerting almost no effect. Thus, the distribution of magnetic field is not altered, and the resonance frequency remains substantially unchanged.

Furthermore, with respect to $TE_{301}$ mode, only the portion of the magnetic field in the center is affected and the other portions of the magnetic field are not affected, as shown in FIG. 7C. Thus, the overall distribution of magnetic field is not significantly altered, causing only a small shift in the resonance frequency.

FIG. 8 is a graph representing the content described above in terms of attenuation characteristics. As shown in FIG. 8, only the attenuation in the $TE_{101}$ mode is significantly affected.

As described above, the resonance frequency in the $TE_{101}$ mode is shifted, so that unwanted signals in the proximity of the resonance frequency in the $TE_{101}$ mode are blocked, whereby the spurious-response characteristics in the proximity of the resonance frequency in the $TE_{101}$ mode are improved.

Next, the construction of a dielectric filter according to a third embodiment will be described with reference to FIGS. 9A and 9B, FIGS. 10A to 10C, and FIG. 11.

Figure 9A:
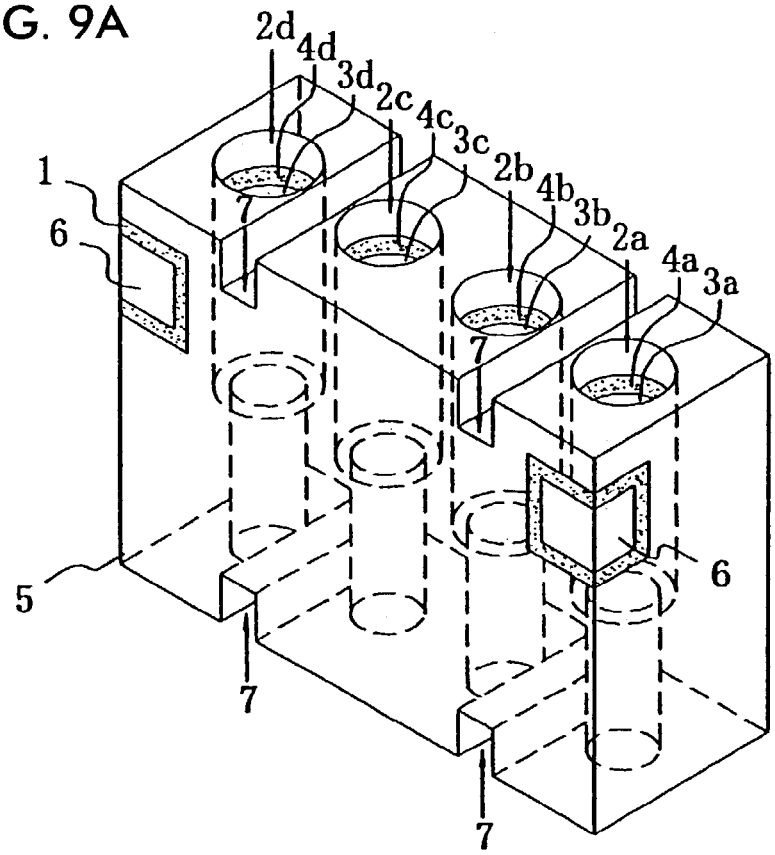
FIGS. 9A and 9B are, respectively, an external perspective view and a side view of a dielectric filter according to a third embodiment.
Figure 9B:
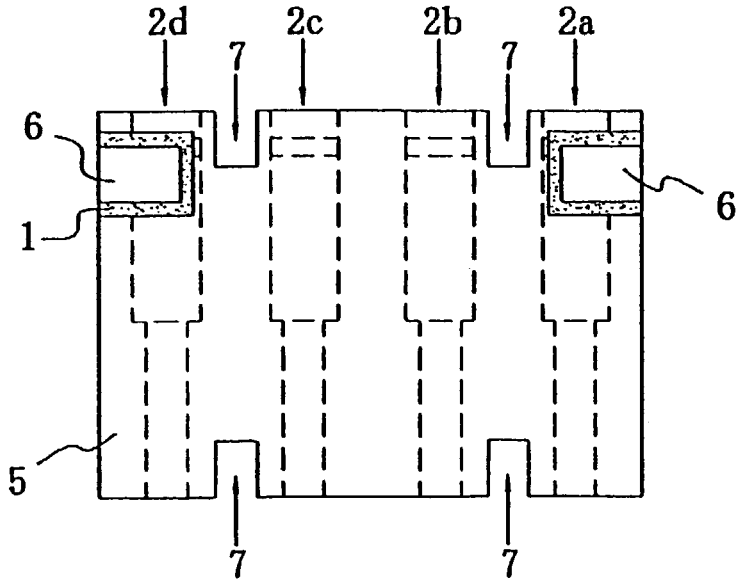

FIGS. 9A and 9B are, respectively, an external perspective view and a side view of the dielectric filter.

Figure 10A:
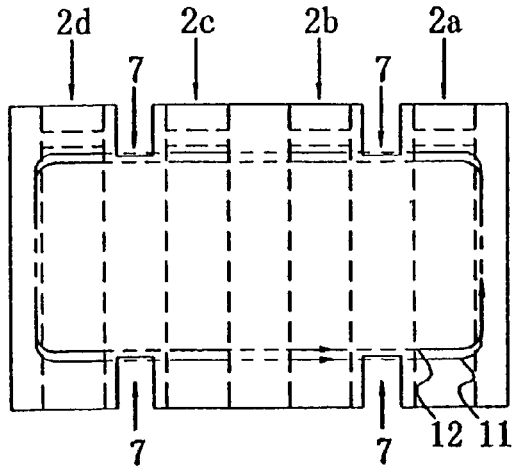
FIGS. 10A, 10B, and 10C are diagrams showing the distributions of magnetic fields in each TE mode generated in the dielectric filter according to the third embodiment.
Figure 10B:
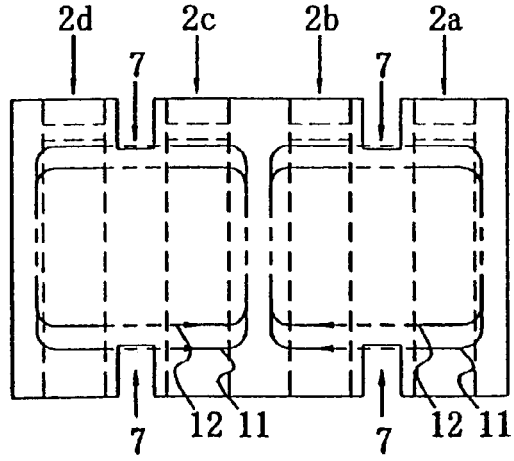
Figure 10C:
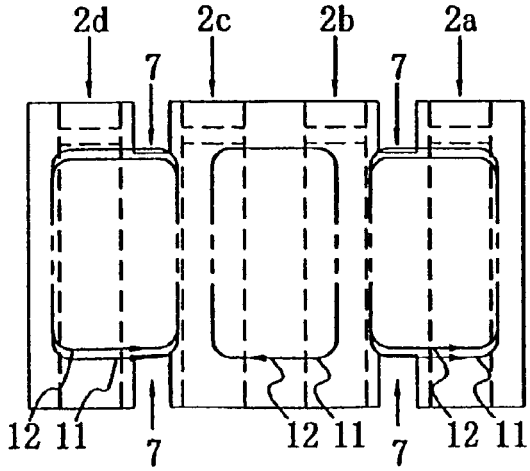

FIGS. 10A, 10B, and 10C show the distributions of magnetic fields generated in the dielectric filter, respectively in the $TE_{101}$ mode, the $TE_{201}$ mode, and the $TE_{301}$ mode.

Figure 11:
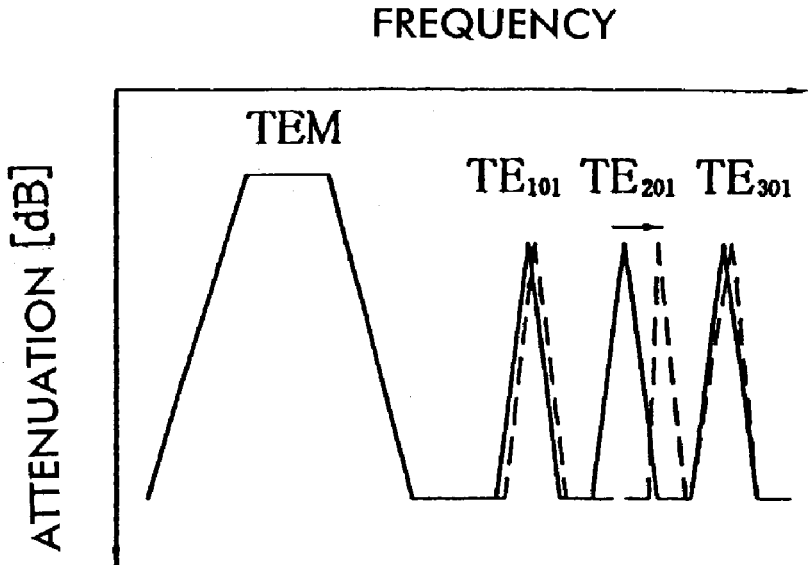
FIG. 11 is a graph showing the attenuation characteristics of the dielectric filter according to the third embodiment.

FIG. 11 is a graph showing the attenuation characteristics of the dielectric filter.

In FIGS. 9A and 9B and FIGS. 10A to 10C, 1 indicates a dielectric block, 2*a* to 2*d* indicate inner-conductor holes, 3*a* to 3*d* indicate inner conductors, 4*a* to 4*d* indicate non-conductor portions, 5 indicates an outer conductor, 6 indicate input and output electrodes, and 7 indicate concavities. 11 and 12 show the distributions of magnetic fields in each of the TE modes, respectively for a case where the concavities 7 are not provided and for a case where the concavities 7 are provided.

Referring to FIGS. 9A and 9B, from the top surface to the bottom surface of the substantially rectangular dielectric block 1, the inner-conductor holes 2*a* to 2*d* are formed, and the inner conductors 3*a* to 3*d* are formed respectively on the inner surfaces of the inner-conductor holes 2*a* to 2*d*. The outer conductor 5 is formed substantially over the entire outer surface of the dielectric block 1.

In the inner-conductor holes 2*a* to 2*d*, the non-conductor portions 4*a* to 4*d* are formed respectively in the proximity of one of the surfaces in which the apertures of the inner conductor holes 2*a* to 2*d* are formed. These portions define the open ends of the inner conductors 3*a* to 3*d*, and the other surface defines the shorted ends. On the outer surface of the dielectric block 1, the input and output electrodes 6, isolated from the outer conductor 5, are formed so as to be capacitively coupled with the open ends.

On both of the surfaces in which the apertures of the inner-conductor holes 2*a* to 2*d* are formed, the concavities 7 are extended in the axial direction of the inner-conductor holes 2*a* to 2*d*, each being disposed at a respective position distant from a corresponding nearest end surface in the direction of array of the inner-conductor holes 2*a* to 2*d* by a quarter of the width of the dielectric block 1 in said direction. The inner surfaces of the concavities 7 are covered with the outer conductor 5, whereby the entire dielectric filter is formed.

According to the above construction, the concavities 7 are formed in the regions where the magnetic field in the $TE_{201}$ mode is most intense. Thus, the distribution of magnetic field is significantly altered, so that the wavelength of the magnetic field component in the $TE_{201}$ mode is equivalently shortened, whereby the resonance frequency is shifted towards higher frequencies.

Furthermore, with respect to the $TE_{101}$ mode and the $TE_{301}$ mode, the concavities 7 are formed in the regions where the magnetic fields are weak, as shown in FIGS. 10A and 10C. Thus, the distributions of magnetic fields are not altered, and the resonance frequency remains substantially unchanged.

FIG. 11 is a graph representing the content described above in terms of attenuation characteristics. As shown in FIG. 11, only the attenuation in the $TE_{201}$ mode is significantly affected.

As described above, the resonance frequency in the $TE_{201}$ mode is shifted, so that unwanted signals in the proximity of the resonance frequency in the $TE_{201}$ mode are blocked, whereby the spurious-response characteristics in the proximity of the resonance frequency in the $TE_{201}$ mode are improved.

Next, the construction of a dielectric filter according to a fourth embodiment will be described with reference to FIGS. 12A and 12B.

Figure 12A:
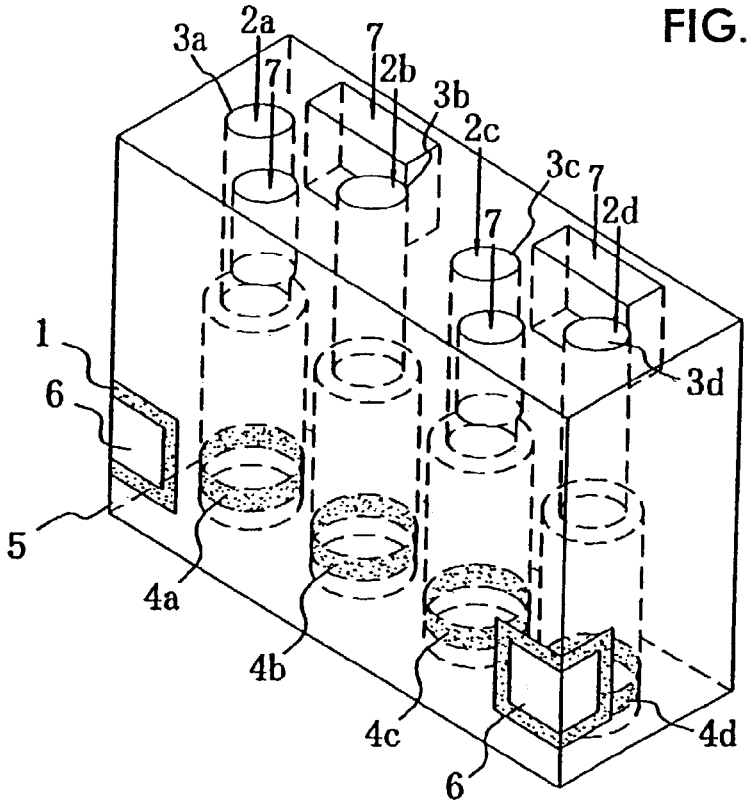
FIGS. 12A and 12B are, respectively, an external perspective view and a side view of a dielectric filter according to a fourth embodiment.
Figure 12B:
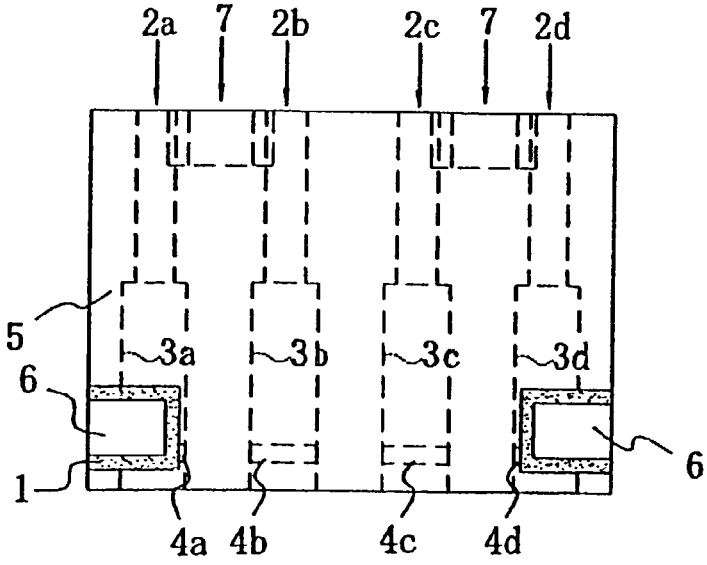

FIGS. 12A and 12B are, respectively, an external perspective view and a side view of the dielectric filter.

In FIGS. 12A and 12B, 1 indicates a dielectric block, 2*a* to 2*d* indicate inner-conductor holes, 3*a* to 3*d* indicate inner conductors, 4*a* to 4*d* indicate non-conductor portions, 5 indicates an outer conductor, 6 indicate input and output electrodes, and 7 indicate concavities.

In the dielectric filter shown in FIGS. 12A and 12B, the plurality of concavities 7 is formed in localized regions not including spaces between the inner-conductor holes 2*a* to 2*d* in one of the surfaces in which the apertures of the inner-conductor holes 2*a* to 2*d* are formed, and not in the two edges of that surface parallel to the direction of array of the inner-conductor holes 2*a* to 2*d*. The construction is otherwise the same as that of the dielectric filter shown in FIGS. 9A and 9B.

According to the above construction, in a case in which the adjacent inner-conductor holes are disposed very close to each other, the concavities 7 can be formed without altering the capacitive coupling between the inner conductors. In addition, due to the concavities 7, the wavelength of the magnetic field component in each of the TE modes is equivalently shortened, so that the resonance frequency is shifted toward higher frequencies, whereby the spurious-response characteristics are improved.

Also in the above embodiment, it is seen that the concavities can have various cross-sectional shapes while still obtaining the advantages of the invention.

Next, the constructions of dielectric filters according to a fifth embodiment will be described with reference to FIGS. 13A and 13B and FIGS. 14A and 14B.

Figure 13A:
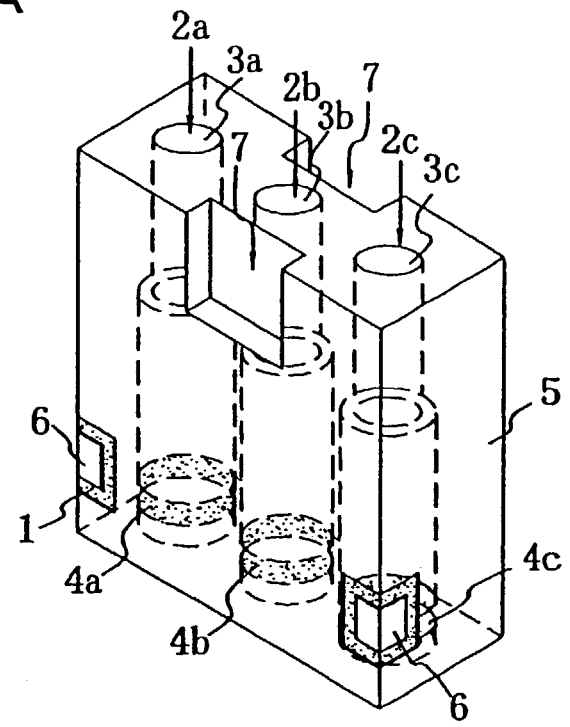
FIGS. 13A and 13B are, respectively, an external perspective view and a side view of a dielectric filter according to a fifth embodiment.
Figure 13B:
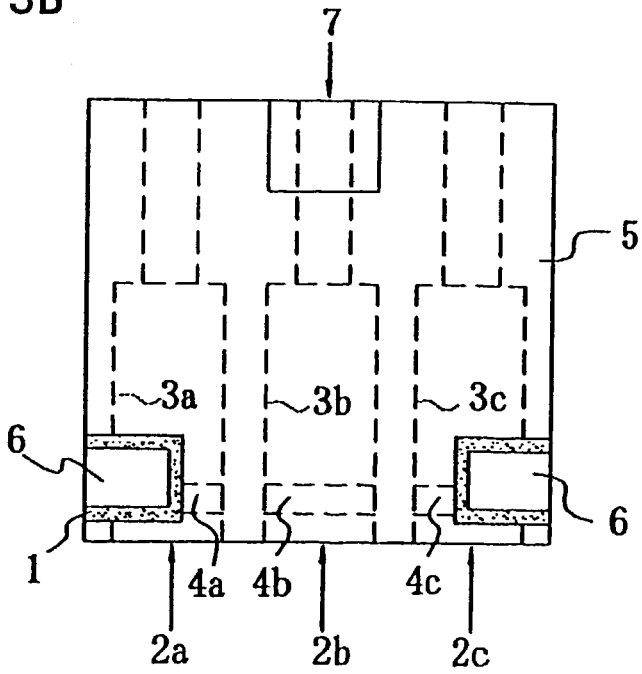

FIGS. 13A and 13B are, respectively, an external perspective view and a side view of a dielectric filter.

Figure 14A:
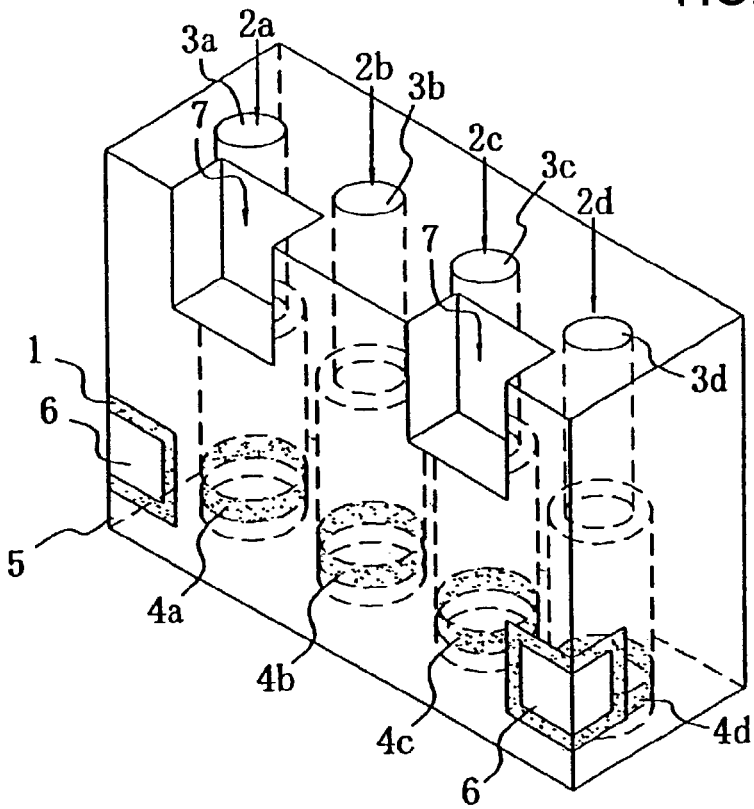
FIGS. 14A and 14B are, respectively, an external perspective view and a side view of another dielectric filter according to the fifth embodiment.
Figure 14B:
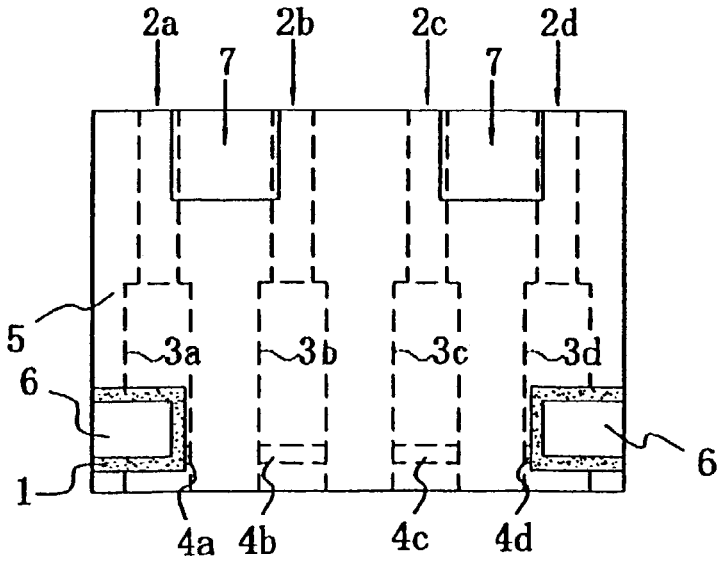

FIGS. 14A and 14B are, respectively, an external perspective view and a side view of another dielectric filter.

In FIGS. 13A and 13B, 1 indicates a dielectric block, 2*a* to 2*c* indicate inner-conductor holes, 3*a* to 3*c* indicate inner conductors, 4*a* to 4*c* indicate non-conductor portions, 5 indicates an outer conductor, 6 indicate input and output electrodes, and 7 indicate concavities. Similarly, in FIGS. 14A and 14B, 1 indicates a dielectric block, 2*a* to 2*d* indicate inner-conductor holes, 3*a* to 3*d* indicate inner conductors, 4*a* to 4*d* indicate non-conductor portions, 5 indicates an outer conductor, 6 indicate input and output electrodes, and 7 indicate concavities.

In the dielectric filters shown in FIGS. 13A and 13B and FIGS. 14A and 14B, each of the plurality of concavities 7 is cut perpendicularly into one of the surfaces in which the apertures of the inner-conductor holes are formed, and also perpendicularly into one of the surfaces parallel to both the axial direction and the direction of array of the inner-conductor holes, so that a portion of the edge adjacent to those two surfaces is cut out. The construction of the dielectric filter shown in FIGS. 13A and 13B is basically the same as that of the dielectric filter shown in FIGS. 1A to 1C, and the construction of the dielectric filter shown in FIGS. 14A and 14B is basically the same as that of the dielectric filter shown in FIGS. 9A and 9B. Other concavities can optionally be provided, in addition to those shown.

According to the constructions, because the concavities are formed at the edges of one of the surfaces in which the apertures of the inner-conductor holes 2*a* to 2*c* are formed, the concavities can be readily formed by a simple process and without cutting the inner-conductor holes 2*a* to 2*c*. In addition, due to the concavities, the wavelength of the magnetic field component in each of the TE modes is equivalently shortened, so that the resonance frequency is shifted toward higher frequencies, whereby the spurious-response characteristics are improved.

Next, the construction of a dielectric filter according to a sixth embodiment will be described with reference to FIGS. 15A and 15B, FIGS. 16A to 16C, and FIG. 17.

Figure 15A:
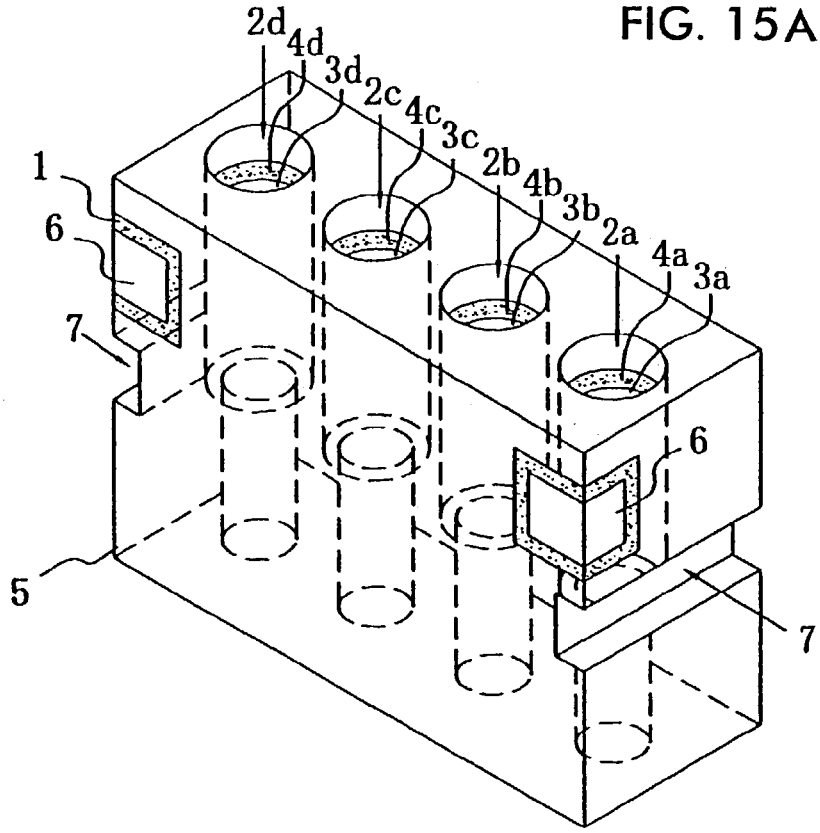
FIGS. 15A and 15B are, respectively, an external perspective view and a side view of a dielectric filter according to a sixth embodiment.
Figure 15B:
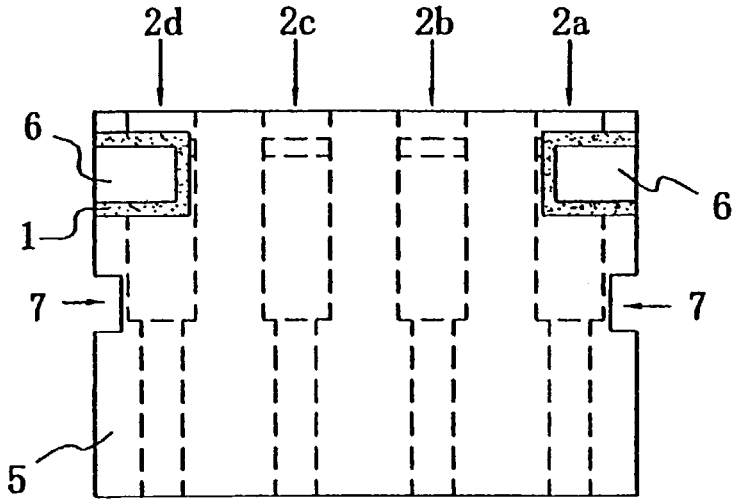

FIGS. 15A and 15B are, respectively, an external perspective view and a side view of the dielectric filter.

Figure 16A:
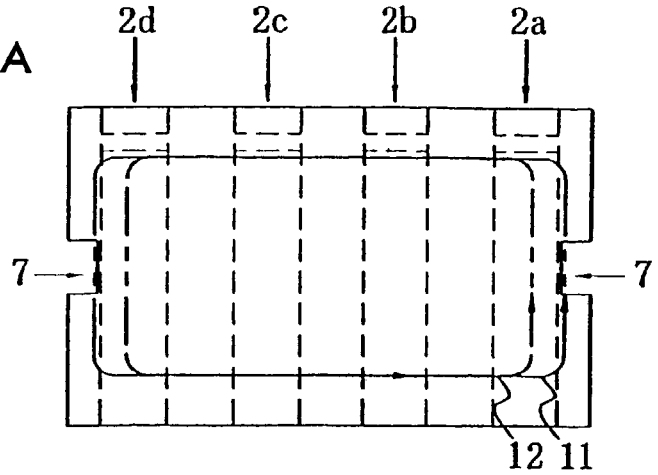
FIGS. 16A, 16B, and 16C are diagrams showing the distributions of magnetic fields in each TE mode generated in the dielectric filter according to the sixth embodiment.
Figure 16B:
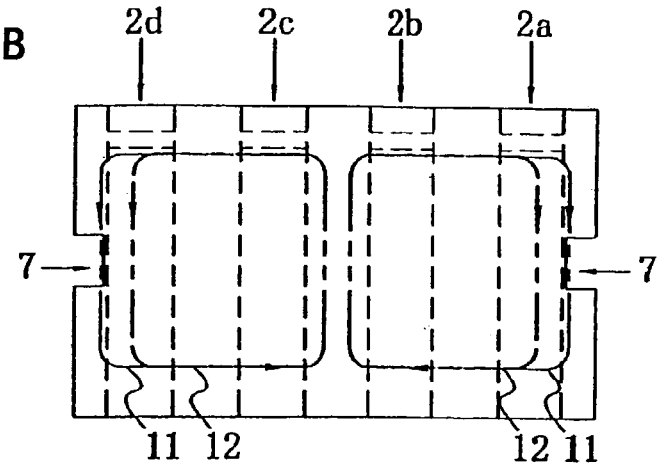
Figure 16C:
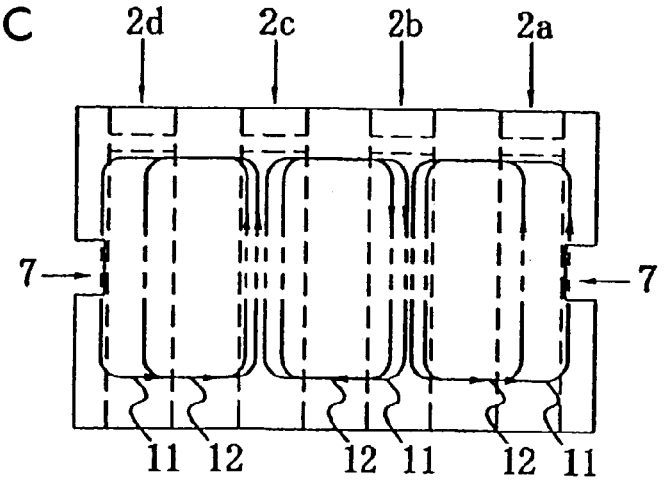
Figure 17:
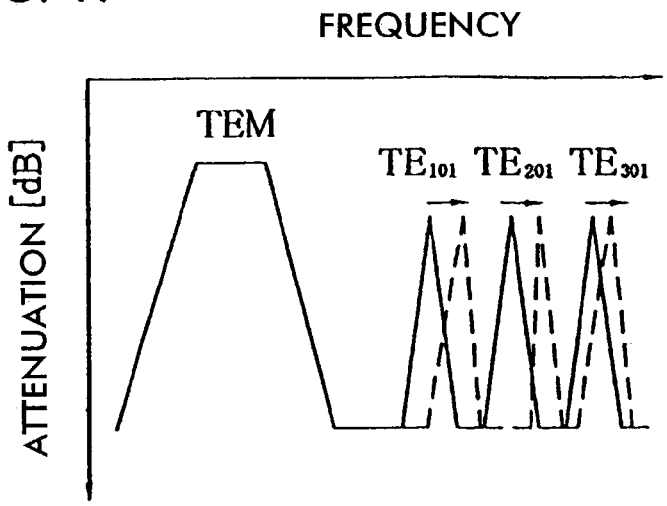
FIG. 17 is a graph showing the attenuation characteristics of the dielectric filter according to the sixth embodiment.

FIGS. 16A, 16B, and 16C are diagrams showing the distributions of magnetic fields generated in the dielectric filter, respectively in the $TE_{101}$ mode, the $TE_{201}$ mode, and in the $TE_{301}$ mode. FIG. 17 is a graph showing the attenuation characteristics of the dielectric filter.

Referring to FIGS. 15A and 15B and FIGS. 16A to 16C, 1 indicates a dielectric block, 2*a* to 2*d* indicate inner-conductor holes, 3*a* to 3*d* indicate inner conductors, 4*a* to 4*d* indicate non-conductor portions, 5 indicates an outer conductor, 6 indicate input and output electrodes, and 7 indicate concavities. 11 and 12 show the distributions of magnetic fields in each of the TE modes, respectively for a case where the concavities 7 are not provided and for a case where the concavities 7 are provided.

Referring to FIGS. 15A and 15B, from the top surface to the bottom surface of the substantially rectangular dielectric block 1, the inner-conductor holes 2*a* to 2*d* are formed, and the inner conductors 3*a* to 3*d* are formed respectively on the inner surfaces of the inner-conductor holes 2*a* to 2*d*. The outer conductor 5 is formed substantially over the entire outer surface of the dielectric block 1.

In the inner-conductor holes 2*a* to 2*d*, the non-conductor portions 4*a* to 4*d* are formed respectively in the proximity of one of the surfaces in which the apertures of the inner-conductor holes 2*a* to 2*d* are formed. These portions provide open ends of the inner conductors 3*a* to 3*d*, and the other surface provides shorted ends. On the outer surface of the dielectric block 1, the input and output electrodes 6, isolated from the outer conductor 5, are formed so as to be capacitively coupled with the open ends.

Furthermore, in the central portions of the end surfaces in the direction of array of the inner-conductor holes 2*a* to 2*d*, the concavities 7 are cut in the direction of array of the inner-conductor holes 2*a* to 2*d*, the inner surfaces thereof being covered with the outer conductor 5, whereby the entire dielectric filter is formed.

According to the construction, as shown in FIGS. 16A to 16C, the concavities 7 are provided on the regions where the magnetic fields are most intense. Thus, the distributions of magnetic fields in the $TE_{101}$, $TE_{201}$, and $TE_{301}$ modes are significantly altered, so that the wavelength of each of the magnetic fields components in the TE modes is equivalently shortened, whereby the resonance frequency is shifted towards higher frequencies. As for higher TE modes such as $TE_{401}$ mode, the resonance frequency is also shifted towards higher frequencies.

FIG. 17 is a graph representing the content described above in terms of attenuation characteristics. As shown in FIG. 17, the attenuation in each of the TE modes is significantly affected.

As described above, the resonance frequency in each of the TE modes is shifted, so that unwanted signals in the proximity of the resonance frequency in each of the TE modes are blocked, whereby the spurious-response characteristics are improved.

Next, the construction of a dielectric filter according to a seventh embodiment will be described with reference to FIGS. 18A and 18B and FIG. 19.

Figure 18A:
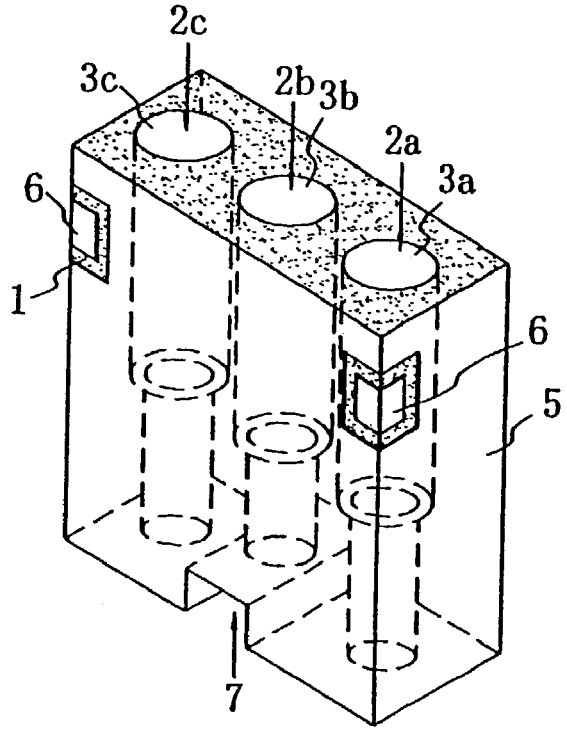
FIGS. 18A and 18B are, respectively, an external perspective view and a side view of a dielectric filter according to a seventh embodiment.
Figure 18B:
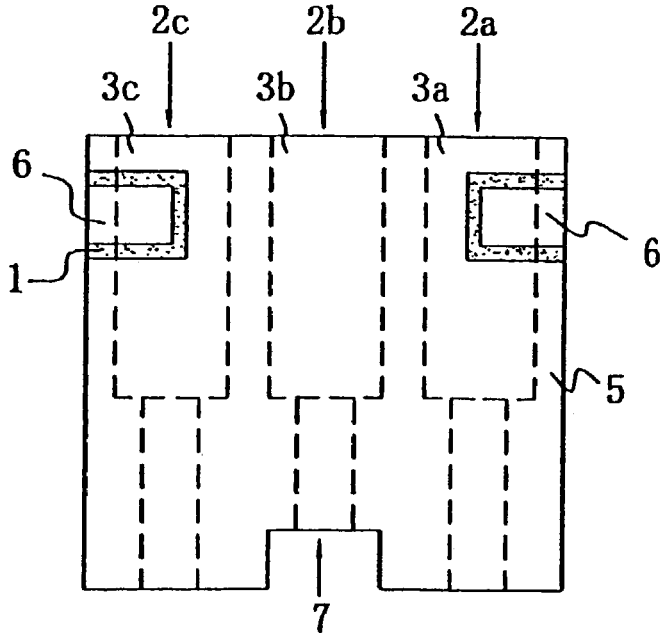

FIGS. 18A and 18B are, respectively, an external perspective view and a side view of the dielectric filter.

Figure 19:
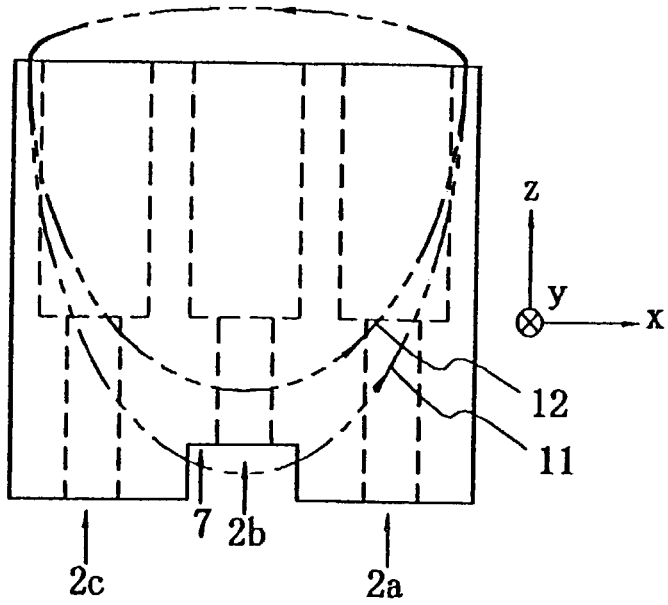
FIG. 19 is a diagram showing the distribution of a magnetic field in the $TE_{101}$ mode generated in the dielectric filter according to the seventh embodiment.

FIG. 19 is a diagram showing the distribution of a magnetic field in the $TE_{101}$ mode generated in the dielectric filter.

In FIGS. 18A and 18B and FIG. 19, 1 indicates a dielectric block, 2*a* to 2*c* indicate inner-conductor holes, 3*a* to 3*c* indicate inner conductors, 5 indicates an outer conductor, 6 indicates input and output electrodes, and 7 indicates a concavity. 11 and 12 show the distribution of a magnetic field in the $TE_{101}$ mode, respectively for a case where the concavity 7 is not provided and for a case where the concavity 7 is provided.

Referring to FIGS. 18A and 18B, from the top surface to the bottom surface of the substantially rectangular dielectric block 1, the inner-conductor holes 2*a* to 2*c* are formed, and the inner conductors 3*a* to 3*c* are formed respectively on the inner surfaces of the inner-conductor holes 2*a* to 2*c*. The outer electrode 5 is formed over five of the outer surfaces of the dielectric block 1, the remaining surface being the top surface, i.e., one of the surfaces in which the apertures of the inner-conductor holes 2*a* to 2*c* are formed.

With the uncovered surface as the open-end surface and the opposite surface as the shorted-end surface, the input and output electrodes 6, isolated from the outer conductor 5, are formed so as to be coupled with the open-end surface.

Furthermore, the concavity 7 is cut in the axial direction of the inner-conductor holes 2*a* to 2*c* substantially at the central portion of the shorted-end surface, the inner surface thereof being covered with the outer conductor 5, whereby the entire dielectric filter is formed.

In the dielectric filter of the above construction, a magnetic field in the $TE_{101}$ mode is distributed as shown in FIG. 19.

As shown in FIG. 19, the concavity 7 is provided in a region where the magnetic field in the $TE_{101}$ mode is most intense in the dielectric filter. Thus, the magnetic field is significantly altered, so that the wavelength of the magnetic field component in the $TE_{101}$ mode is equivalently shortened, whereby the resonance frequency is shifted toward higher frequencies.

As described above, the resonance frequency in the $TE_{101}$ mode is shifted, so that unwanted signals in the proximity of the resonance frequency in $TE_{101}$ mode are blocked, whereby the spurious-response characteristics in the proximity of the resonance frequency in the $TE_{101}$ mode are improved.

Next, the construction of a dielectric duplexer according to an eighth embodiment will be described with reference to FIGS. 20A and 20B.

Figure 20A:
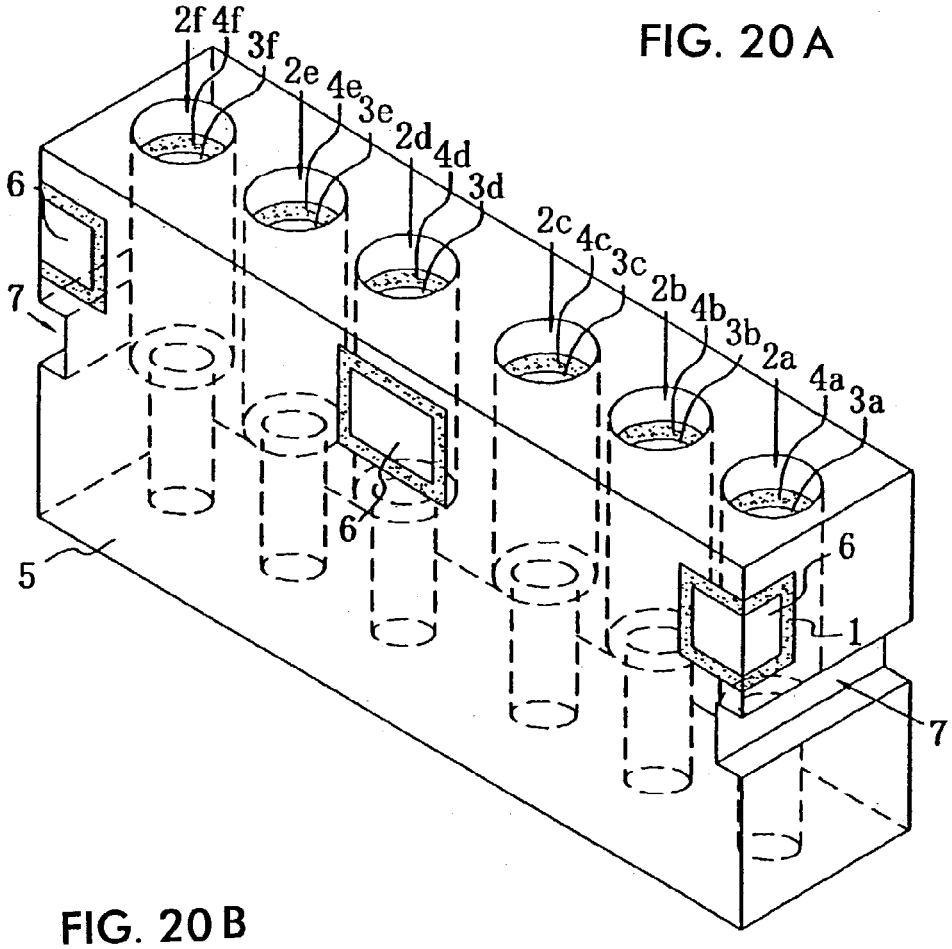
FIGS. 20A and 20B are, respectively, an external perspective view and a side view of a dielectric duplexer according to an eighth embodiment.
Figure 20B:
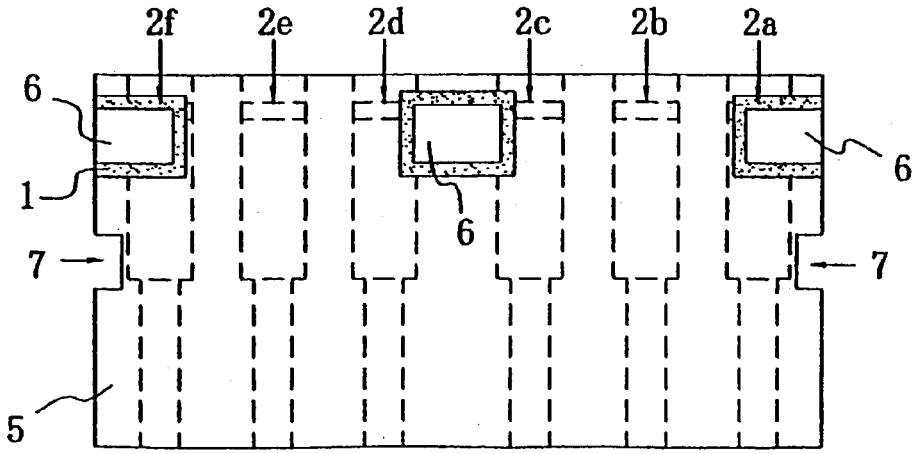

FIGS. 20A and 20B are, respectively, an external perspective view and a side view of the dielectric duplexer.

In FIGS. 20A and 20B, 1 indicates a dielectric block, 2*a* to 2*f* indicate inner-conductor holes, 3*a* to 3*f* indicate inner conductors, 4*a* to 4*f* indicate non-conductor portions, 5 indicates an outer conductor, 6 indicates input and output electrodes, and 7 indicates concavities.

Referring to FIGS. 20A and 20B, from the top surface to the bottom surface of the substantially rectangular dielectric block 1, the inner-conductor holes 2*a* to 2*f* are formed, and the inner conductors 3*a* to 3*f* are formed respectively on the inner surfaces of the inner-conductor holes 2*a* to 2*f*. The outer conductor 5 is formed substantially over the entire outer surface of the dielectric block 1.

In the inner-conductor holes 2*a* to 2*f*, the non-conductor portions 4*a* to 4*f* are formed respectively in the proximity of one of the surfaces in which the apertures of the inner-conductor holes 2*a* to 2*f* are formed. These portions provide the open ends of the inner conductors 3*a* to 3*f*, and the other surface provides the shorted ends. The input and output electrodes 6, isolated from the outer conductor 5, are formed so as to be capacitively coupled with the open ends.

Furthermore, in the proximity of the central portions of the end surfaces in the direction of array of the inner-conductor holes 2*a* to 2*f*, the concavities 7 are formed in the direction of array of the inner-conductor holes 2*a* to 2*f*, the inner surfaces thereof being covered with the outer conductor 5.

The inner-conductor holes 2*a* to 2*c* constitute a transmitting filter, and the inner-conductor holes 2*d* to 2*f* constitute a receiving filter, whereby the entire dielectric duplexer is formed.

According to this construction, as described previously in relation to the sixth embodiment, the magnetic fields in each of the TE modes are altered, so that the wavelengths of the magnetic field components are equivalently shortened. Thus, the resonance frequency in each of the TE modes is shifted, so that unwanted signals in the proximity of the resonance frequency in each of the TE modes are blocked, whereby the spurious-response characteristics are improved.

Similarly to the previous embodiments which relate to a discrete dielectric filter, in a dielectric duplexer as well, concavities may be formed in the surfaces in which the apertures of inner-conductor holes are formed and are not limited to being in the end surfaces in the direction of array of the inner-conductor holes.

Furthermore, similarly to the dielectric filter according to the seventh embodiment, concavities may be formed in a dielectric duplexer in which the open ends are provided by not forming the outer conductor on one of the surfaces in which the apertures of the inner-conductor holes are formed.

In the dielectric filters and the dielectric duplexer described above, the sectional shape of the inner-conductor holes is not limited to being a circular shape, and may be an elliptical shape, an oval shape, a polygon shape, etc. Likewise, the cross-sectional shape of the concavity is not limited to the disclosed shapes.

Furthermore, in a dielectric filter or a dielectric duplexer in which concavities are formed in one of the surfaces in which the apertures of the inner-conductor holes are formed, similar advantages can be obtained whether the concavities are formed in the open-end surface or in the shorted-end surface.

Next, the construction of a communications apparatus according to a ninth embodiment will be described with reference to FIG. 21.

Figure 21:
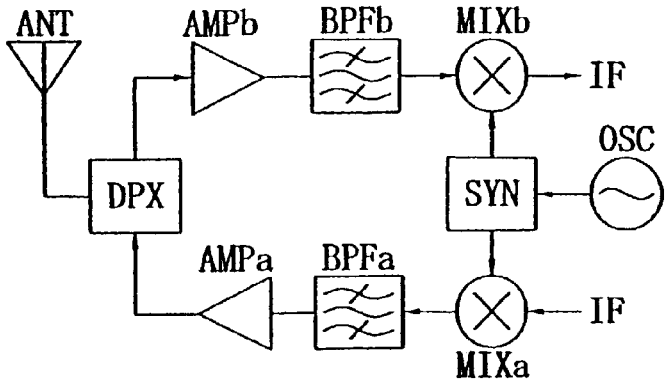
FIG. 21 is a block diagram of a communications apparatus according to a ninth embodiment.
Figure 22A:
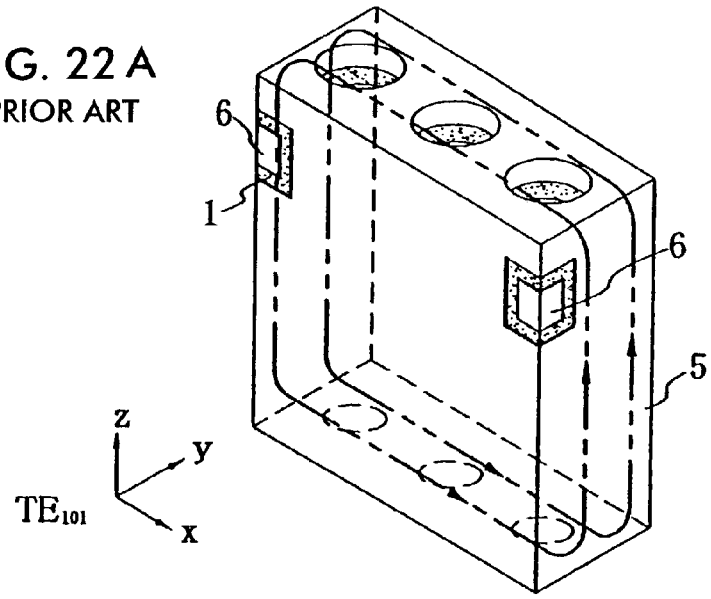
FIG. 22 A PRIOR ART
FIG. 22A is a diagram showing the distribution of a magnetic field in a TE mode generated in a known dielectric filter.
Figure 22B:
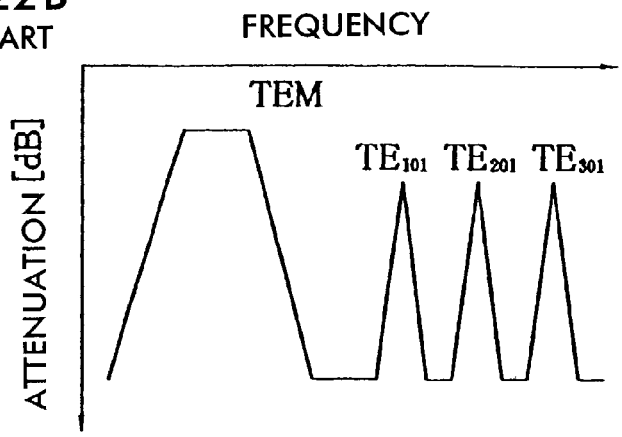
FIG. 22B PRIOR ART
FIG. 22B is a graph showing the attenuation characteristics of the known dielectric filter.

Referring to FIG. 21, ANT indicates a transmitting and receiving antenna, DPX indicates a duplexer, BPFa and BPFb respectively indicate band-pass filters, AMPa and AMPb respectively indicate amplification circuits, MIXa and MIXb respectively indicate mixers, OSC indicates an oscillator, SYN indicates a synthesizer, and IF indicates an intermediate-frequency signal.

The band-pass filters BPFa and BPFb shown in FIG. 21 can each be implemented by one of the dielectric filters shown in FIGS. 1A and 1B, FIGS. 6A and 6B, FIGS. 9A and 9B, FIGS. 12A and 12B, FIGS. 13A and 13B, FIGS. 14A and 14B, FIGS. 15A and 15B, and FIGS. 18A and 18B. The duplexer DPX can be implemented by the dielectric duplexer shown in FIGS. 20A and 20B. As described above, by using a dielectric filter and a dielectric duplexer having good attenuation characteristics, a communications apparatus having good communications characteristics can be implemented.

Although the present invention has been described in relation to particular embodiments thereof, many other variations and modifications and other uses will become apparent to those skilled in the art. Therefore, the present invention is not limited by the specific disclosure herein.

What is claimed is:

1. A dielectric filter comprising:

a substantially rectangular dielectric block;

a plurality of inner-conductor holes having respective apertures in a first end surface of said dielectric block and in a second end surface which is opposite to said first end surface of said dielectric block;

a plurality of inner conductors formed respectively on inner surfaces of said plurality of inner-conductor holes;

at least one concavity formed in one of a pair of opposed third and fourth end surfaces of the dielectric block, said pair of opposed third and fourth end surfaces forming side surfaces of the dielectric block in an array direction of said plurality of inner-conductor holes, said at least one concavity not extending onto the first and second end surfaces of the dielectric block and not intersecting any of the inner-conductor holes; and an outer conductor formed on an outer surface of said dielectric block including an inner surface of said at least one concavity.

2. A dielectric filter according to claim 1, wherein said at least one concavity is formed substantially in a central portion of at least one of the third and fourth end surfaces which are arranged at the ends of said dielectric block in a direction of array of said plurality of inner-conductor holes.

3. A dielectric duplexer comprising a pair of dielectric filters, at least one of said filters being a dielectric filter according to claim 1.

4. A communications apparatus comprising a transmitting circuit, a receiving circuit, and a dielectric duplexer according to claim 3, said transmitting circuit being connected to an input of said dielectric duplexer, said receiving circuit being connected to an output of said dielectric duplexer.

5. A communications apparatus comprising at least one of a transmitting circuit and a receiving circuit, said circuit including a dielectric filter according to claim 1.

* * * * *